US006966458B2

(12) United States Patent
Robinson

(10) Patent No.: US 6,966,458 B2
(45) Date of Patent: Nov. 22, 2005

(54) BEVERAGE TOWER TAP LOCK

(76) Inventor: Jon J. Robinson, 180 Washington St., Golden, CO (US) 80403

( * ) Notice: Subject to any disclaimer, the term of this patent is extended or adjusted under 35 U.S.C. 154(b) by 123 days.

(21) Appl. No.: 10/447,583

(22) Filed: May 28, 2003

(65) Prior Publication Data

US 2004/0238569 A1 Dec. 2, 2004

(51) Int. Cl.[7] ..... B67D 5/32
(52) U.S. Cl. ..... 222/153.02; 222/153.03; 222/400.7
(58) Field of Search ..... 222/153.02, 153.03, 222/153.14, 400.7, 400.8

(56) References Cited

U.S. PATENT DOCUMENTS 784,994 A * 3/1905 Durafort ..... 222/399
4,291,821 A * 9/1981 Nezworski ..... 222/153.04
4,911,333 A * 3/1990 Wilson ..... 222/153.14
5,394,715 A * 3/1995 Guerette ..... 70/177
5,487,493 A * 1/1996 McNabb ..... 222/153.14
5,607,084 A * 3/1997 George ..... 222/153.03
5,941,103 A * 8/1999 Stearns ..... 70/178
6,648,178 B2 * 11/2003 Grunewald ..... 222/153.02

* cited by examiner

*Primary Examiner*—Joseph A. Kaufman

(57) ABSTRACT

The beverage tap lock of the present invention is intended for use with a beverage tower having multiple taps. In commercial systems on the market, there is a gap (a first distance) between the back of the taps (where there is a faucet-coupling nut behind the handle and faucet of the tap) and the front of the beverage tower. The taps are spaced apart by a second distance, which is normally regular (i.e. a "pitch" between the taps). The tap lock has a back plate having a plurality of indentations towards the back. In order to allow the back plate to fit in the gap between taps and tower, the thickness of the back plate is no more than the first distance and in presently preferred embodiments and best modes now contemplated is in fact less than the first distance.

17 Claims, 4 Drawing Sheets

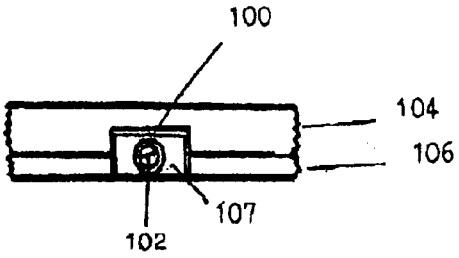
FIGURE 10
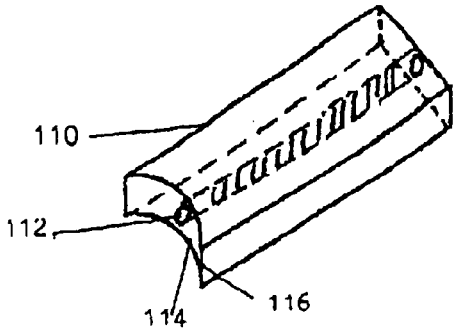
FIGURE 11
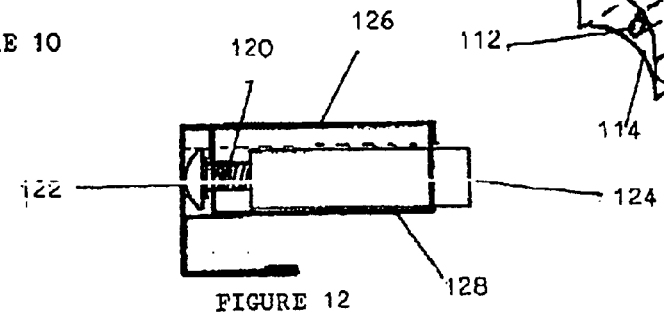
FIGURE 12
FIGURE 13
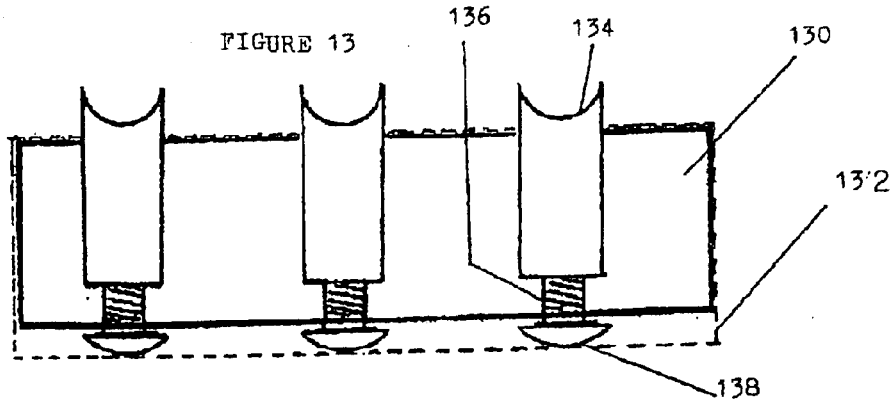
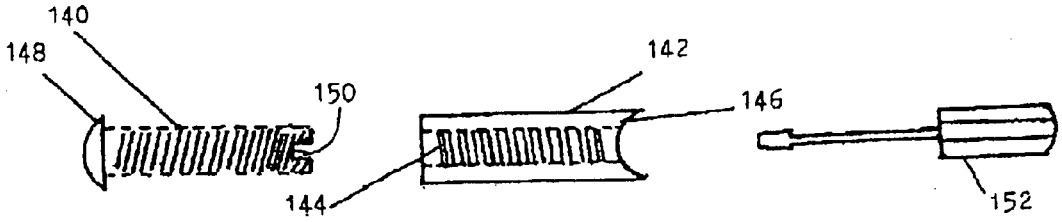
FIGURE 14

FIGURE 16
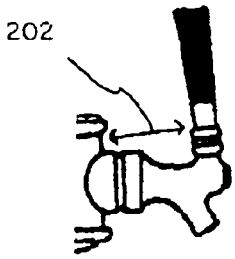
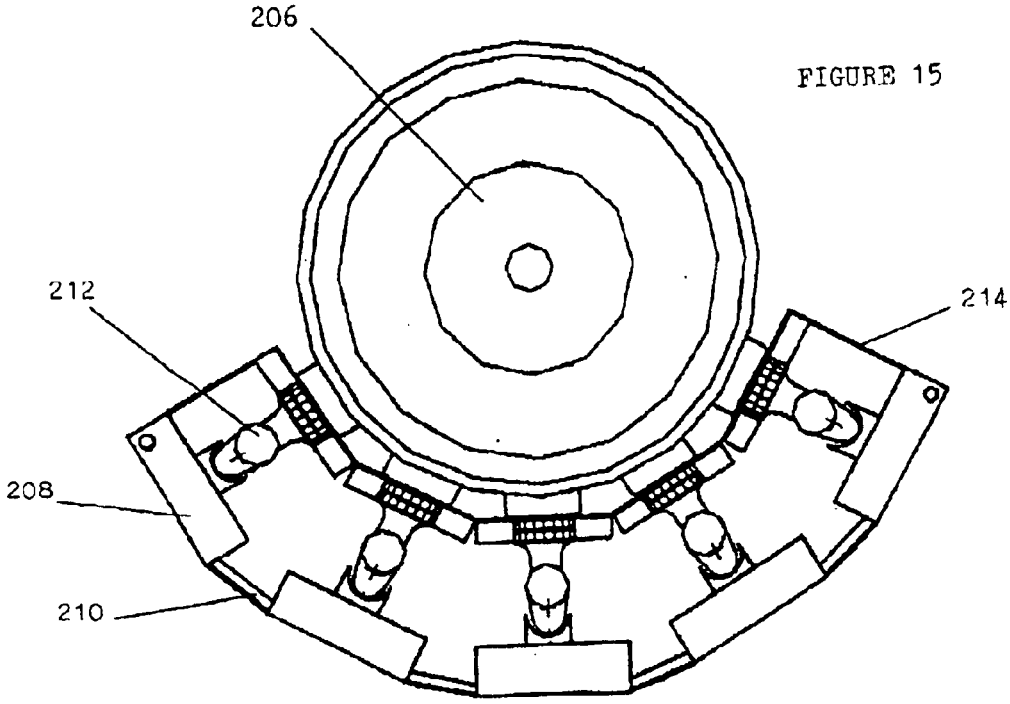
FIGURE 15

BEVERAGE TOWER TAP LOCK

FIELD OF THE INVENTION

This invention relates generally to commercial beverage dispensers, and specifically to locks for the taps of commercial beverage dispensers.

BACKGROUND OF THE INVENTION

Beverage taps in certain types of public establishments (commercial or non-commercial) necessarily are designed for a large volume of beverage output. Sports venues, hotels, bars, restaurants, dance venues, pizza parlors and a host of other types of establishments typically require a plurality of taps (usually one or more tap per brand of beverage) either when a varied customer preferences make a large number of beer types commercially preferable, or in order to meet peak demands when a number of orders arrive simultaneously.

Regardless of the number of taps present, the problem of after hours losses can be a serious one, especially in locations which cannot be physically secured so as to prevent unauthorized access. For example, a restaurant located in a hotel may be open for business (and thus guarded) only a portion of the day, but may be open in the sense of accessible to hotel guests, employees and others round the clock.

For both legal and economic reasons, it behooves such establishments to secure the beverage taps. Yet technology for securing such taps is not entirely suited to the purpose.

One solution is the individual tap lock. This device has a lock and key and is either integral to the tap or is fitted onto the lock at the time of locking. Four types are known to be marketed at the present time. Two types of individual locks are similar to each other and feature a lock suited for a key. The lock screws up and down to force to the tap handle into its fully closed position. Another type of individual lock is similar but includes a fitting over the nozzle to prevent liquid from being dispensed therefrom. A rather more sophisticated alternative is a mechanism built into a single tap shaft which prevents the shaft from being moved when force is applied to the handle. It is still individual, however, and requires an expensive investment or retrofit. All four are individual tap locks, and all four require the use of special locking mechanisms.

Unfortunately, in high volume dispensation establishments, there are typically a number of taps on each beverage tower. Applying and locking one lock to one tap and then repeating the process repeatedly is cumbersome and many establishments either forego doing so (leaving their taps unlocked when unattended) or else resort to measures such as disconnecting the kegs or other containers or pumps from the taps so as to stop the flow of beverage. This results in product wastage, lost profits, and is itself a non-optimal solution to the problem. That such measures are taken indicates the poor match between the devices actually on the market and needs of multiple tap beverage tower owners.

Searches of the US Patent Office's database have revealed the following art.

U.S. Pat. No. 6,286,724 issued Sep. 11, 2001 to Midden for LOCK STRUCTURE FOR A COLD DRINK SYSTEM teaches the only purely multiple tap system found in this search. The device actually consists of a cable which passes through several faucets of a soda fountain or slushed ice drink type dispenser. The cable is then locked. The structure is different enough from the present invention to be of modest relevance.

U.S. Pat. No. 5,941,103 issued Aug. 24, 1999 to Stearns FAUCET LOCKING DEVICE teaches one of several "enclosure" type devices which wholly or partially enclose a single tap. As with commercially known prior art, this device envisions forcing the user to employ a plural number of devices in order to cover a plural number of taps, see column 4, lines 10–23. The box and lid of the device conform to the shape of the single tap covered. However, in addition to not teaching a multiple tap lock, it further teaches enclosure of the tap faucet as the locking mechanism, and argues (column 3, lines 19–28) against attempting to prevent motion of the dispensing knob. Finally, it suggests minimum play between the faucet assembly and device, see column 5, lines 54–65.

U.S. Pat. No. 5,607,084 issued Mar. 4, 1997 to George for LOCKING SYSTEM FOR BEVERAGE TAPS teaches a locking system of the tap interior type, having little structural similarity to the present invention.

U.S. Pat. No. 5,394,715 issued Mar. 7, 1995 to Guerette for RETAINING MECHANISM FOR A LIQUID DISPENSING APPARATUS VALVE teaches a hook mechanism to fit around the tap handle from the back, again having limited structural similarity to the present invention.

U.S. Pat. No. 5,211,313 issued May 18, 1993 to Lucking et al for DISPENSING TAPS teaches a locking mechanism which is used for cask or bottle taps, not beverage towers. It appears to have little structural similarity to the present invention.

U.S. Pat. No. 4,890,769 issued Jan. 2, 1990 to Armstrong for BEVERAGE DISPENSING LOCK teaches a locking device actually designed for handheld taps. The device has front and back parts which enclose the handheld tap. Since the structure of a handheld tap and a beverage tower tap is radically different this device does not teach significant matter of the present invention. For example, the device covers the buttons on the back of the handheld tap, whereas the present invention blocks motion of a handle. In short, the device could not in any way be used to lock a beverage tower tap.

U.S. Pat. No. 4,111,243 issued Sep. 5, 1978 to Fetterman for BEVERAGE DISPENSING DEVICE teaches a digital/electronic control box for a single tap.

U.S. Pat. No. 2,462,951 issued Mar. 1, 1949 to P. T. Doubble for LOCKING MEANS FOR OIL BARRELS is actually from an entirely different technical area not pertaining to beverages. However, it does disclose a cylindrical box locked down atop an oil barrel spigot. Since the device is a single lock, not a plural design, and is from a distant technology, it does not features of the present invention.

U.S. Pat. No. 2,377,036 issued May 29, 1945 to H. B. Quarfoot for ANTI-TAMPERING ATTACHMENT FOR VALVES teaches a valve enclosure box for industrial valves. The box is suitable only for use with valves radically different from the taps of a beverage tower, and is a single valve device in any case.

Finally, not found in the patentability search but found by the applicant, "Stuever and Sons" offers to the market a device similar to that of the '103 patent discussed previously, which attempts to block access to the faucet/outlet of the tap, not prevent handle motion. That device does at least fit over the outlet/nozzle of several sequential taps on a beverage tower: a cylinder or square tube fits under the bottom of the outlet/nozzles/faucets of a line of taps (no handle involvement is known to applicant, nor does the device fit over and conform to the shape of the taps). This device may be more for visual effect than actual prevention of beverage dispensing: since the handles can be pulled, it would appear that beverages may be dispensed into the tube to cause bacteria buildup. The device will not work with taps having faucet/outlets of differing lengths.

Establishments as discussed previously have complained that there is an unmet need for a simple device which can lock all of the taps on a beverage tower without undue labor.

Therefore, it would be advantageous to provide a simple system for locking multiple taps on a beverage tower. It would furthermore be advantageous to provide a system which does not require drilling or other retrofitting to the tap/tower assembly. It would furthermore be advantageous if the tap lock could work with ordinary padlocks.

SUMMARY OF THE INVENTION

General Summary

The beverage tap lock of the present invention is intended for use with a beverage tower having multiple taps. In commercial systems on the market, there is a gap (a first distance) between the back of the taps (where there is a faucet-coupling nut behind the handle and faucet of the tap) and the front of the beverage tower. The taps are spaced apart by a second distance, which is normally regular (i.e. a "pitch" between the taps). The tap lock has a back plate having a plurality of indentations towards the back. In order to allow the back plate to fit in the gap between taps and tower, the thickness of the back plate is in best modes now contemplated and presently preferred embodiments slightly less than the first distance. Due to the unique floating block aspect of the invention, it may easily accommodate taps having different first distances from the tower. The distance from the centerline of one indentation to the centerline of the next indentation is approximately the second "pitch" distance from one tap to the next. The word approximately is used in this context to indicate that some play is allowed in order to allow the device to be used on towers having slightly different tap pitch distances.

First and second extension arms on the back plate extend forwards past the taps, and an eye upon the first extension arm will be used to accept one or more normal padlocks. A front face box engages the first and second extension arms and a padlock may then be inserted therethrough.

In embodiments, the front box further includes top and bottom casing portions which cooperate to contain a floating block. The floating block in turn is dimensioned and configured to block motion of the tap handles. In the best mode now contemplated, the floating block contains end-slotted bolts which may be adjusted when the invention is unlocked and removed or disassembled. Such adjustment allows the device to be adjusted to different configurations of beverage tower taps.

Summary in Reference to Claims

It is yet another aspect, advantage, embodiment and objective of the present invention to provide a beverage tap lock for use with a beverage tower having multiple taps, the taps located a first distance from the front of the beverage tower, the taps spaced apart by a second pitch distance, the taps each having a handle thereon, the tap lock comprising: a back plate having a front, a back, a top, a bottom, a first end and a second end, the front having a plurality of indentations towards the back, wherein the thickness of the back plate is no more than the first distance, and the distance from the centerline of one indentation to the centerline of the next indentation is approximately the second pitch distance, and first and second extension arms at the respective first and second ends; and having an eye upon the first extension arm; a front face box having first and second retainers dimensioned and configured to physically engage to the first and second extension arms; the eye being located, dimensioned and configured so that when the first retainer is physically engaged with the first extension arm, a passage through the eye permits insertion of an elongated body therethrough. The elongated body may be a rod, the hasp of a lock, or a similar device.

It is yet another aspect, advantage, embodiment and objective of the present invention to provide a tap lock wherein the front face box further comprises: a top box part.

It is yet another aspect, advantage, embodiment and objective of the present invention to provide a tap lock wherein the front face box further comprises: a bottom box part, the bottom box part and the top box part being dimensioned and configured to form at least one cavity therebetween when the top box part is disposed upon the bottom box part.

It is yet another aspect, advantage, embodiment and objective of the present invention to provide a tap lock wherein the top box and bottom box are dimensioned and configured to provide a hole from the cavity to the exterior through the rear of the front box.

It is yet another aspect, advantage, embodiment and objective of the present invention to provide a tap lock further comprising: at least one floating block disposed within the cavity, the floating block comprising a projecting part extending out from the cavity through the hole.

It is yet another aspect, advantage, embodiment and objective of the present invention to provide a tap lock wherein the floating block's projecting part further comprises a conforming surface dimensioned and configured to physically engage part of such a tap when the device is used on such beverage tower.

It is yet another aspect, advantage, embodiment and objective of the present invention to provide a tap lock wherein the conforming surface is dimensioned and configured to physically engage such tap handle.

It is yet another aspect, advantage, embodiment and objective of the present invention to provide a tap lock wherein the floating block further comprises a threaded hole at the conforming surface.

It is yet another aspect, advantage, embodiment and objective of the present invention to provide a tap lock wherein the floating block further comprises a threaded body disposed within the threaded hole, the threaded body having a first end disposed towards the conforming surface, the first end further having one member selected from the group consisting of: a slot, a Phillips head, an Allan head, a hex head, and combinations thereof.

It is yet another aspect, advantage, embodiment and objective of the present invention to provide a tap lock further comprising a second hole in the front box and a second identical floating block disposed within the cavity so as to project from the second hole, wherein the distance from the centerline of the first floating block to the centerline of the second floating block is approximately the second pitch distance.

It is yet another aspect, advantage, embodiment and objective of the present invention to provide a tap lock wherein when the tap lock is installed on the beverage tower, the indentations extend in one direction selected from the group consisting of: upwards, downwards, away from the beverage tower, and combinations thereof.

It is yet another aspect, advantage, embodiment and objective of the present invention to provide a tap lock wherein the general planform of the device comprises one member selected from the group consisting of: straight, arcuate, irregular, angled, and combinations thereof.

It is yet another aspect, advantage, embodiment and objective of the present invention to provide a tap lock wherein the plurality of indentations comprise a low common denominator.

It is yet another aspect, advantage, embodiment and objective of the present invention to provide a tap lock for use with a beverage tower having multiple taps, the taps located a first distance from the front of the beverage tower, the taps spaced apart by a second pitch distance, the taps each having a handle thereon, the tap lock system comprising: a first tap lock comprising: a back plate having a front, a back, a top, a bottom, a first end and a second end, the front having a first plural number of indentations towards the back, wherein the thickness of the back plate is no more than the first distance, and the distance from the centerline of one indentation to the centerline of the next indentation is approximately the second pitch distance, and first and second extension arms at the respective first and second ends; and having an eye upon the first extension arm; a front face box having first and second retainers dimensioned and configured to physically engage to the first and second extension arms; the eye being located, dimensioned and configured so that when the first retainer is physically engaged with the first extension arm, a passage through the eye permits insertion of an elongated body therethrough; and a second tap lock comprising: a back plate having a front, a back, a top, a bottom, a first end and a second end, the front having a second plural number of indentations towards the back, wherein the thickness of the back plate is no more than the first distance, and the distance from the centerline of one indentation to the centerline of the next indentation is approximately the second pitch distance, and first and second extension arms at the respective first and second ends; and having an eye upon the first extension arm; a front face box having first and second retainers dimensioned and configured to physically engage to the first and second extension arms; the eye being located, dimensioned and configured so that when the first retainer is physically engaged with the first extension arm, a passage through the eye permits insertion of an elongated body therethrough.

It is yet another aspect, advantage, embodiment and objective of the present invention to provide a tap lock system wherein the first plural number and the second plural number are different from one another and are both low common denominators.

It is yet another aspect, advantage, embodiment and objective of the present invention to provide a tap lock system wherein the first plural number is in the range from 2 indentations to 10 indentations, preferably from 2 to 5, most preferably from 2 to 4.

BRIEF DESCRIPTION OF THE DRAWINGS

FIG. 10 is a partial rear view of the front box of a twelfth embodiment of the invention.

FIG. 11 is an oblique elevational transparent view of the adjustable floating block 110 thirteenth embodiment of the invention FIG. 12 is a cross-sectional side view of the front box 126 of the invention's fourteenth embodiment.

FIG. 13 is a cross-sectional top view the front box of the fifteenth embodiment of the invention.

FIG. 14 is a cross-sectional side view of the floating block of the sixteenth embodiment of the invention.

FIG. 15 is a top view of a beverage tower in which the taps are arranged in an arc.

FIG. 16 is a side view of a single tap, showing the first distance.

DETAILED DESCRIPTION

Figure 1:
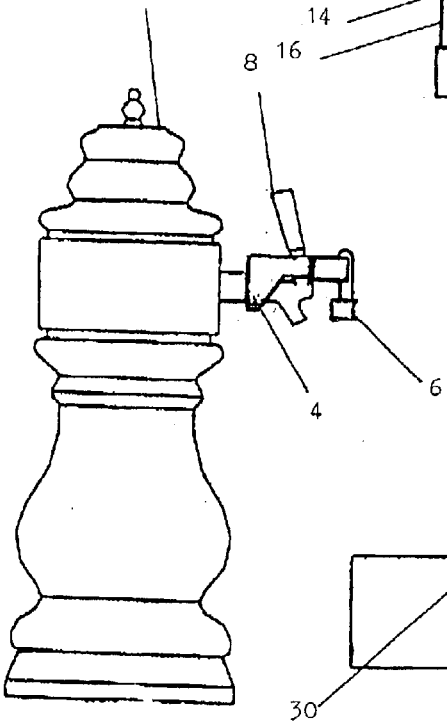
FIG. 1 is a side view of a beverage tower 2 showing invention 4 according to a first embodiment thereof.
Figure 2:
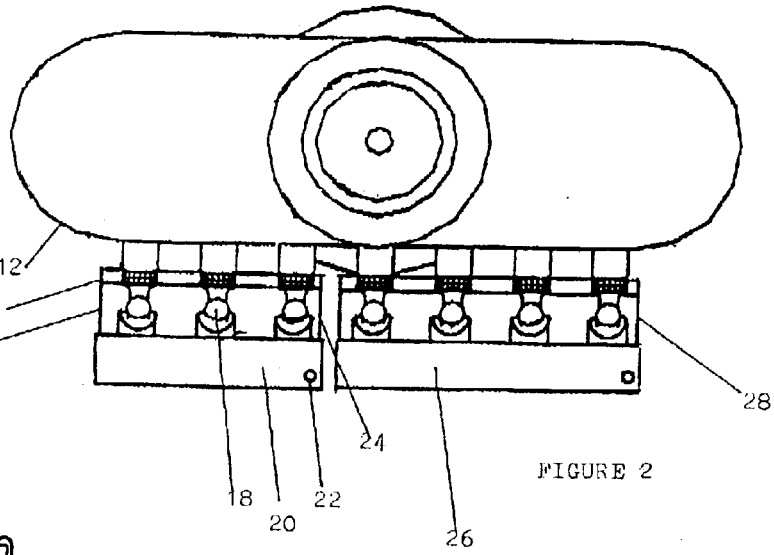
FIG. 2 is a top view of a beverage tower 12 showing back plate 14, first extension arm 16, tap handle 18, front box 20, eye 22, second extension arm 24, all of a second embodiment of the invention, and showing a third embodiment of the invention on the same beverage tower 12 showing front box 26 and extension arm 28. In these embodiments, back plate 14 rises up around the taps.

FIG. 1 is a side view of a beverage tower 2 showing invention 4 according to a first embodiment of the invention, padlock 6, and tap 8. In general, it may be seen that tower 2 has tap 8 projecting from the front thereof. (FIG. 16 is a side view of a single tap, showing the first distance indicated by arrow 202.) Since tap 8 of FIG. 1 is one of a line of taps spaced from the tower by a uniform first distance, only one tap may be seen in side view. While the taps are generally illustrated as being a uniform first distance from the tower, alternative embodiments allow use with taps which have various distances from the tower. In general, invention 4 sits both in front and behind of tap 8 and other similarly configured taps. Tap lock 4 thus prevents operation of the tap 8, as will be explained further below in reference to other embodiments. Padlock 6, which may be an ordinary padlock of inexpensive manufacture, is then used to secure tap lock 4 to tap 8. FIG. 2 is a top view of a beverage tower 12 showing back plate 14, first extension arm 16, tap handle 18, front box 20, eye 22, second extension arm 24, all of a second embodiment of the invention, and showing a third embodiment of the invention on the same beverage tower 12 showing front box 26 and extension arm 28. In these embodiments, back plate 14 rises up around the taps. That is, back plate 14 is installed from below, with the indentations of the back plate running vertically downwards from the top of back plate 14 so that portions of back plate 14 between the indentations (the projections) rise up among the taps. As will be discussed in reference to other embodiments, this arrangement may altered.

It will be seen that the third and second embodiments differ in length: the third embodiment is dimensioned and configured to fit behind and in front of four taps, while the second embodiment sits behind and in front of three taps. In general, a tap lock for three taps will have three indentations of the back plate, a length commensurate with three taps, three locations on the front box 20 which block the action of the three taps (as will be discussed further in relations to figures 10 through 14). Obviously, a four tap lock will have four of each of these and an appropriate length.

Figure 4:
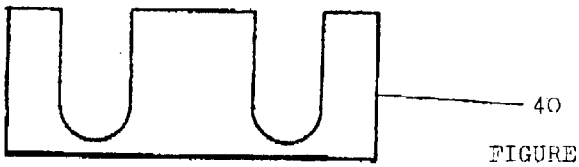
FIG. 4 is a front view of back plate 40 of a sixth embodiment of the invention.
Figure 5:
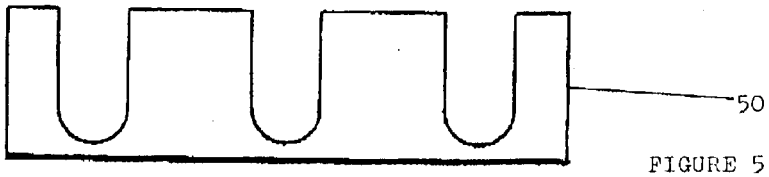
FIG. 5 is a front view of back plate 50 of a seventh embodiment of the invention.
Figure 6:
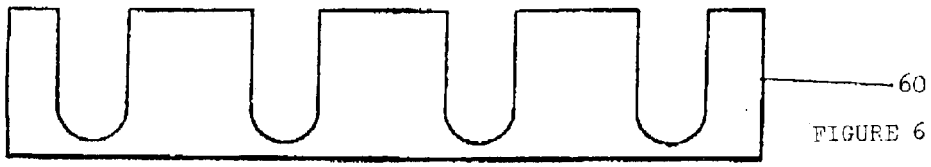
FIG. 6 is a front view of back plate 60 of an eighth embodiment of the invention.

Note that it would be impractical to provide embodiments which could individually meet the needs of tower owners having towers with almost any conceivable number of taps. For example, some beverage towers may have only one or two taps, while others may have 20 or more taps. Obviously, it would increase cost and decrease the commercial value of multiple tap locks to provide tap locks dedicated to every possible number of taps on the tower: seven taps, 13 taps, and so on. However, by supplying tap locks dimensioned and configured to lock a smaller number of locks corresponding to low common denominators of most numbers, it becomes possible to use a relatively small number of devices to lock beverage towers with any number of taps. As shown in FIG. 2, a seven tap tower may be locked with a three tap lock and a four tap lock. This is an enormous saving of time and cost over the use of seven individual locks, especially as it does not require special retrofitting of tower. At the same time, it offers an economical way to protect a seven tap tower short of actually providing a single seven tap lock which would be useful only on the small number of seven tap towers extant. Presently preferred embodiments of the invention provide a two tap lock device, a three tap lock device, and a four tap lock device, though other low common denominators may be employed. FIG. 4 is a "top" view of back plate 40 of a sixth embodiment of the invention. FIG. 5 is a "top" view of back plate 50 of a seventh embodiment of the invention. FIG. 6 is a "top" view of back plate 60 of an eighth embodiment of the invention. As may be seen, these three embodiments fall within a meta-embodiment in which two, three and four tap locks are used as a system. Thus, these back plates have lengths, dimensions and numbers of indentations which fit two, three or four taps. Of course, other groups of low common denominators may be used. In use, it will be seen that any number of taps from two to four may be covered with a single device. Thereafter, combinations of only two tap locks will suffice to cover up to eight taps, three devices may be used to cover up to 12 taps, four and five cover up to 20 taps and so on. Note that other combinations of low common denominators may be used: a five tap embodiment may be used to add additional flexibility while the four tap version may be dropped, and so on. Another embodiment may use numbers from 2 to 10.

Figure 3:
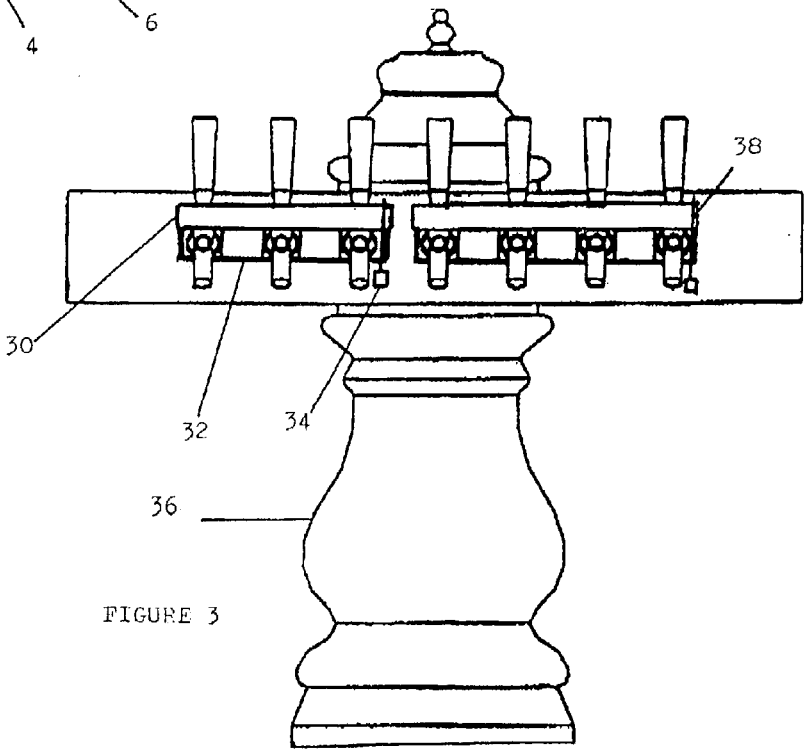
FIG. 3 is a front view of a beverage tower 36 showing a fourth embodiment of the invention having front box 30, back plate 32 and padlock 34. Fifth embodiment 38 is also shown. In these two embodiments, back plate 32 is lowered down over the taps.

FIG. 3 is a front view of a beverage tower 36 showing a fourth embodiment of the invention having front box 30, back plate 32 and padlock 34. Fifth embodiment 38 is also shown. In these embodiments, back plate 32 is lowered down over the taps. Thus the indentations are actually extending vertically upwards, with the projections of back plate 32 extending downwards among the taps.

The taps of most beverage towers are positioned at a uniform distance, referred to as second pitch distance, from adjacent taps. However, in some towers, this distance may not be uniform. Worse, the pitch distance of towers made by different manufacturers varies somewhat. While the variation is small, the result is that an exact fit is possible but economically undesirable. Those embodiments having an exact fit are necessarily limited to certain beverage tower manufacturers. On the other hand, the preferred embodiments offer a slight degree of "play": the indentations have a first width with is only approximately the same as the (second width) of the taps, in particular embodiments, the faucet lock nut. As used herein, the word approximately is used to mean that the difference in width is such that the tap lock when installed cannot be moved laterally a distance sufficient to allow any tap handle to come free of the handle conforming surface of any floating block (both items discussed further in reference to FIGS. 10 to 14), but that the difference is large enough to allow use of the tap lock on beverage towers having second pitch distances which are different.

Figure 7:
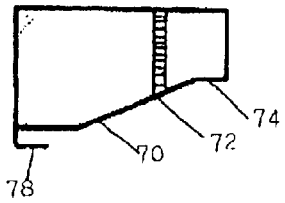
FIG. 7 is a side view of a ninth embodiment of the invention.
Figure 8:
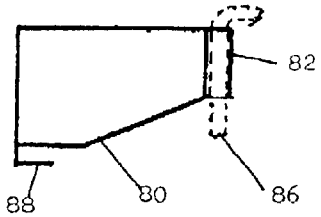
FIG. 8 is a side view of a tenth embodiment of the invention.
Figure 9:
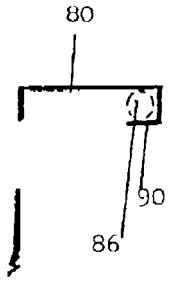
FIG. 9 is a partial top cross-sectional view of an eleventh embodiment of the invention.

The back plate of the invention has first and second arms extending from it at first and second ends, one at each end. The arms are used to connect the device to the front box. FIG. 7 is a side view of a ninth embodiment of the invention. In this embodiment, first arm 70 has hinge 72 connecting it to front box 74. In use, the invention is opened at hinge 72 and the backplate (hidden behind arm 70, which projects from it) is inserted as previously shown behind the row of taps. Thereafter, front box 74 is swung closed over the taps. A single padlock (as shown in FIGS. 1 and 3) is then used to fasten the device closed at the second arm. FIG. 8 is a side view of a tenth embodiment of the invention. In this embodiment, first arm 80 has no hinge and allows elongate body 86 to pass therethrough. Arm 80 may instead have a device such as shown in FIG. 9, which is a partial top cross-sectional view of an eleventh embodiment of the invention and may serve as a top view of the tenth embodiment's second arm. Arm 80 has retainer 90 through which elongate body 86 may be passed. In use, elongate body 86 may most conveniently be the shank of a padlock such as shown in FIGS. 1 and 3. It will be seen that retainer 90 will fit into the space beneath an eye such as eye 22 of FIG. 2, and when elongate body 86 is passed through eye 22 and retainer 90, the result is that the invention may not opened without removing elongate body 86. Elongate body 86 may be the hasp or shackle of a padlock, a rod or bar or similar device.

FIG. 10 is a partial rear view of the front box of a twelfth embodiment of the invention. Top box 104 and bottom box 106 together comprise the front box. Top box 104 has a cavity on the lower surface, while bottom box 106 has a cavity on the top surface. The top and bottom box, when put together as shown, are dimensioned and configured so as to combine to create a single cavity therebetween. A rectangular hole through the rear of top box 104 and bottom box 106 allows adjustable floating block 107 to protrude into view from the single cavity in which floating block 107 is disposed. A bolt hole through floating block 107 then allows view of bolt 100 having slot 102. Slot 102 is dimensioned and configured to physically engage an adjustment tool such as a flat head screwdriver. In other embodiments, slot 102 may be replaced with a "Phillips" head screw, a hex head, an "Allen" hex indentation or other similar device.

FIG. 11 is an oblique elevational transparent view of the adjustable floating block 110 of the thirteenth embodiment of the invention. Block 110 has a threaded hole 112 extending therethrough. Conforming surface 114 is configured and dimensioned to physically engage to a tap handle. It will be seen in FIGS. 1 through 3 that the front box has extensions which meet the front of the tap handles and thus prevent the taps from being opened when the handle is pulled. These extensions are floating blocks such as block 110. Conforming surface 114 allows a more secure fit to the tap handle. Projection 116 of conforming surface 114 extends from conforming surface 114 towards the tower and prevents motion of the tap handle laterally off of the floating block when floating block 110 is firmly applied to the tap handle.

FIG. 12 is a cross-sectional side view of the front box 126 of the invention's fourteenth embodiment. It will be seen that bolt 122 having threads 120 physically engages by means of threads 120 into floating block 124, which has a threaded hole therethrough much like threaded hole 112 of block 10 of the previous embodiment (FIG. 11). When closed, front box 126 encloses floating block 124 and bolt 122.

FIG. 13 is a cross-sectional top view the front box of the fifteenth embodiment of the invention. Top box 132 (shown in outline) somewhat overlaps bottom box 130, with bolt head 138 nestled in between. Bolt 136 and conforming surface 134 may be seen. It will be appreciated that a tap handle, tap knob or other tap accessory may physically engage conforming surface 134.

FIG. 14 is an exploded cross-sectional top view of the floating block of the sixteenth embodiment of the invention. Threads 140 all bolt 148 to fit into and physically engage threaded block 142 at threaded hole 144. Conforming surface 146 is also visible. Slot 150 may be engaged by tool 152 to alter the depth of bolt 148 in block 142. By this means, the device may be adjusted to fit various configurations of taps. It will be appreciated that in various models of beverage tower, the taps are located a first distance from the front of the beverage tower, and this distance varies from maker to maker and model to model. Thus, adjustment as shown in FIG. 14 allows use of a single embodiment of the invention on a number of different towers.

FIG. 15 is a top view of a beverage tower in which the taps are arranged in an arc. Tower 206 has tap 212 which is one member of a plurality of taps which are NOT in a straight line. However, embodiment 214 is shaped to conform to the arrangement of the taps, in this case an arcuate shape. Floating block container 208 is one member of a plurality of containers which are also in an arcuate arrangement held together by means of connection 210 and similar members. In addition to arcuate shapes, other shapes may be utilized in alternative embodiments of the invention. This general planform of the device may thus comprise one member selected from the group consisting of: straight, arcuate, irregular, angled, and combinations thereof. In such cases, it is desirable to subdivide the front box into a plurality of floating block containers as shown.

It will be understood that while a set first distance is discussed, the taps may be of differing constructions and distances from the tower. The unique floating block and front box system of the invention allows the device to be adapted to a wide range of depths and handle configurations. Thus, the tap may be used in a beverage tower having a plurality of differing first distances. When used in a beverage tower having a plurality of differing first distances, the tap lock further comprises at least a second thickness of the back plate, the second thickness located at a different location on the back plate than the first thickness of the back plate.

The disclosure is provided to allow practice of the invention by those skilled in the art without undue experimentation, including the best mode presently contemplated and the presently preferred embodiment. Nothing in this disclosure is to be taken to limit the scope of the invention, which is susceptible to numerous alterations, equivalents and substitutions without departing from the scope and spirit of the invention. The scope of the invention is to be understood from the appended claims.

What is claimed is:

1. A beverage tap lock for use with a beverage tower having multiple taps, the taps located a first distance from the front of the beverage tower, the taps spaced apart by a second pitch distance, the taps each having a handle thereon, the tap lock comprising:

a back plate having a front, a back, a top, a bottom, a first end and a second end, the front having a plurality of indentations towards the back, wherein the thickness of the back plate is no more than the first distance, and the distance from the centerline of one indentation to the centerline of the next indentation is approximately the second pitch distance, and first and second extension arms at the respective first and second ends; and having an eye upon the first extension arm;

a front face box having first and second retainers dimensioned and configured to physically engage to the first and second extension arms; the eye being located, dimensioned and configured so that when the first retainer is physically engaged with the first extension arm, a passage through the eye permits insertion of an elongated body therethrough.

2. The tap lock of claim 1, wherein the front face box further comprises:

a top box part.

3. The tap lock of claim 2, wherein the front face box further comprises:

a bottom box part, the bottom box part and the top box part being dimensioned and configured to form at least one cavity therebetween when the top box part is disposed upon the bottom box part.

4. The tap lock of claim 3, wherein the top box and bottom box are dimensioned and configured to provide a hole from the cavity to the exterior through the rear of the front box.

5. The tap lock of claim 4, further comprising:

at least one floating block disposed within the cavity, the floating block comprising a projecting part extending out from the cavity through the hole.

6. The tap lock of claim 5, wherein the floating block's projecting part further comprises a conforming surface dimensioned and configured to physically engage part of such a tap when the device is used on such beverage tower.

7. The tap lock of claim 6, wherein the conforming surface is dimensioned and configured to physically engage such tap handle.

8. The tap lock of claim 7, wherein the floating block further comprises a threaded hole at the conforming surface.

9. The tap lock of claim 8, wherein the floating block further comprises a threaded body disposed within the threaded hole, the threaded body having a first end disposed towards the conforming surface, the first end further having one member selected from the group consisting of: a slot, a Phillips head, an Allan head, a hex head, and combinations thereof.

10. The tap lock of claim 9, further comprising a second hole in the front box and a second identical floating block disposed within the cavity so as to project from the second hole, wherein the distance from the centerline of the first floating block to the centerline of the second floating block is approximately the second pitch distance.

11. The tap lock of claim 1, wherein when the tap lock is installed on the beverage tower, the indentations extend in one direction selected from the group consisting of: upwards, downwards, away from the beverage tower, and combinations thereof.

12. The tap lock of claim 1, wherein the plurality of indentations comprise a low common denominator.

13. The tap lock of claim 1, wherein the general planform of the device comprises one member selected from the group consisting of: straight, arcuate, irregular, angled, and combinations thereof.

14. The tap lock of claim 1, used in a beverage tower having a plurality of differing first distances, the tap lock further comprising: at least a second thickness of the back plate.

15. A beverage tap lock system for use with a beverage tower having multiple taps, the taps located a first distance from the front of the beverage tower, the taps spaced apart by a second pitch distance, the taps each having a handle thereon, the tap lock system comprising:

a first tap lock comprising:

a back plate having a front, a back, a top, a bottom, a first end and a second end, the front having a first plural number of indentations towards the back, wherein the thickness of the back plate is no more than the first distance, and the distance from the centerline of one indentation to the centerline of the next indentation is approximately the second pitch distance, and first and second extension arms at the respective first and second ends; and having an eye upon the first extension arm;

a front face box having first and second retainers dimensioned and configured to physically engage to the first and second extension arms; the eye being located, dimensioned and configured so that when the first retainer is physically engaged with the first extension arm, a passage through the eye permits insertion of an elongated body therethrough; and a second tap lock comprising:

a back plate having a front, a back, a top, a bottom, a first end and a second end, the front having a second plural number of indentations towards the back, wherein the thickness of the back plate is no more than the first distance, and the distance from the centerline of one indentation to the centerline of the next indentation is approximately the second pitch distance, and first and second extension arms at the respective first and second ends; and having an eye upon the first extension arm;

a front face box having first and second retainers dimensioned and configured to physically engage to the first and second extension arms; the eye being located, dimensioned and configured so that when the first retainer is physically engaged with the first extension arm, a passage through the eye permits insertion of an elongated body therethrough.

16. The tap lock system of claim 15, wherein the first plural number and the second plural number are different from one another and are both low common denominators.

17. The tap lock system of claim 15, wherein the first plural number is in the range from 2 indentations to 10 indentations.

* * * * *